US005494239A

United States Patent [19]

Giacomel

[11] Patent Number: 5,494,239

[45] Date of Patent: Feb. 27, 1996

[54] EXPANDABLE OGIVE

[75] Inventor: Jeffrey A. Giacomel, Arlington, Tex.

[73] Assignee: Loral Vought Systems Corporation, Grand Prairie, Tex.

[21] Appl. No.: 284,254

[22] Filed: Aug. 2, 1994

[51] Int. Cl.[6] ..... F42B 10/46

[52] U.S. Cl. ..... 244/3.1; 102/293; 244/3.24

[58] Field of Search ..... 89/1.11; 244/3.1, 244/3.24; 102/293

[56] References Cited

U.S. PATENT DOCUMENTS

| | | | |
|---|---|---|---|
| 46,490 | 2/1865 | Orwig | 244/3.27 |
| 2,297,130 | 9/1942 | Bomar | 244/3.27 |
| 3,005,406 | 10/1961 | Ronfeldt | 102/365 |
| 3,256,816 | 6/1966 | Pilcher II | 244/3.27 |
| 3,282,216 | 11/1966 | Calfee et al. | 244/3.3 |
| 3,425,650 | 2/1969 | Silva | 244/130 |
| 3,494,284 | 2/1970 | Gross | 102/491 |
| 3,703,998 | 11/1972 | Girard | 244/13 |
| 4,572,463 | 2/1986 | Ashkenazi | 244/3.3 |
| 4,770,369 | 9/1988 | Flock et al. | 244/3.1 |
| 5,005,781 | 4/1991 | Baysinger et al. | 244/3.26 |
| 5,159,151 | 10/1992 | Dransfield et al. | 102/293 |
| 5,363,767 | 11/1994 | Robinson | 102/374 |

FOREIGN PATENT DOCUMENTS

| | | |
|---|---|---|
| 29815 | 11/1925 | France . |
| 10325 | of 1912 | United Kingdom . |

OTHER PUBLICATIONS

Explosives, Propellants and Pyrotechnics, Bailey and Murray, Chapter 2 entitled "The Explosion Process: Detonation Shock Effects", pp. 21–30.

"Standard Tapers", pp. 926–933.

"Standard Tapers", pp. 1624–1629.

*Primary Examiner*—Charles T. Jordan

*Assistant Examiner*—Christopher K. Montgomery

*Attorney, Agent, or Firm*—Richards, Medlock & Andrews

[57] ABSTRACT

An expandable ogive is disclosed which incorporates a plurality of sections (20, 22, 24) which move into an extended position. The ogive is locked in the extended position by mating tapered surfaces on the piston sections of an actuator (44) which are tapered at an angle of less than about 2° relative to the center line axis of the missile or rocket. The mating surfaces lock sufficiently tightly to resist the aerodynamic loadings on the ogive during missile or rocket flight and therefore maintain the proper ogive configuration independent of the gas pressure in the actuator (44) which initially moves the ogive sections into the extended position.

13 Claims, 12 Drawing Sheets

EXPANDABLE OGIVE

TECHNICAL FIELD OF THE INVENTION

This invention relates to the design of rockets and missiles, and particularly to an expandable ogive on a tactical weapon.

BACKGROUND OF THE INVENTION

Tactical rockets and missiles are a key component on a modern day battlefield. One example is the US Army Tactical Missile or TACMS, which is designed to be launched from a Multiple Launch Rocket System (MLRS) such as the M-270 launcher. The M-270 launcher will mount two missile launch pod assemblies (MLPA) or canisters, with each MLPA or canister containing one TACMS missile or six MLRS rockets or other munitions.

By standardizing the MLPA, different systems (TACMS or MLRS) can be launched from the same vehicle (M-270 launcher, for example). However, the shape of the MLPA constrains the basic volume and length of the missile or rocket since it must fit within the confines of the launch vehicle.

The forward end of the rocket or missile is an aerodynamically shaped nose referred to as an ogive. One characteristic of the ogive is the so-called von Karman ratio which is the ratio of the constant diameter of the flight vehicle to the von Karman equation of the nose shape over the distance in diameters in which the nose shape conforms to the von Karman equation. In order to enhance the capability of rockets or missiles used in standardized flight vehicle configurations, extendable ogives have been developed which extend from the vehicle.

SUMMARY OF THE INVENTION

In accordance with one aspect of the present invention, an expandable ogive for a missile or a rocket is provided. The ogive includes a plurality of concentric ogive sections. At least a first of the concentric sections has a trailing surface and at least a second of the concentric sections has a leading surface. The plurality of concentric ogive sections are movable between a compact configuration with the concentric ogive sections nested together to an expanded configuration with the concentric ogive sections forming an ogive. A gas actuator with a series of tapered piston sections moves the ogive sections to the expanded configuration. The piston sections are locked to each other to hold the ogive in the expanded configuration.

In accordance with another aspect of the present invention, at least the leading and trailing surfaces of the piston sections have a slope of less than about 2°. In accordance with another aspect of the present invention, the slope is between about 1 and 1½°. This gas actuator utilizes a propellant for actuation and a modified Morse taper with a machine finish to aid material seizure upon actuation.

BRIEF DESCRIPTION OF THE DRAWINGS

For a more complete understanding of the present invention and for further advantages thereof, reference is now made to the following detailed description taken in conjunction with the accompanying drawings, in which.

DETAILED DESCRIPTION

Figure 1:
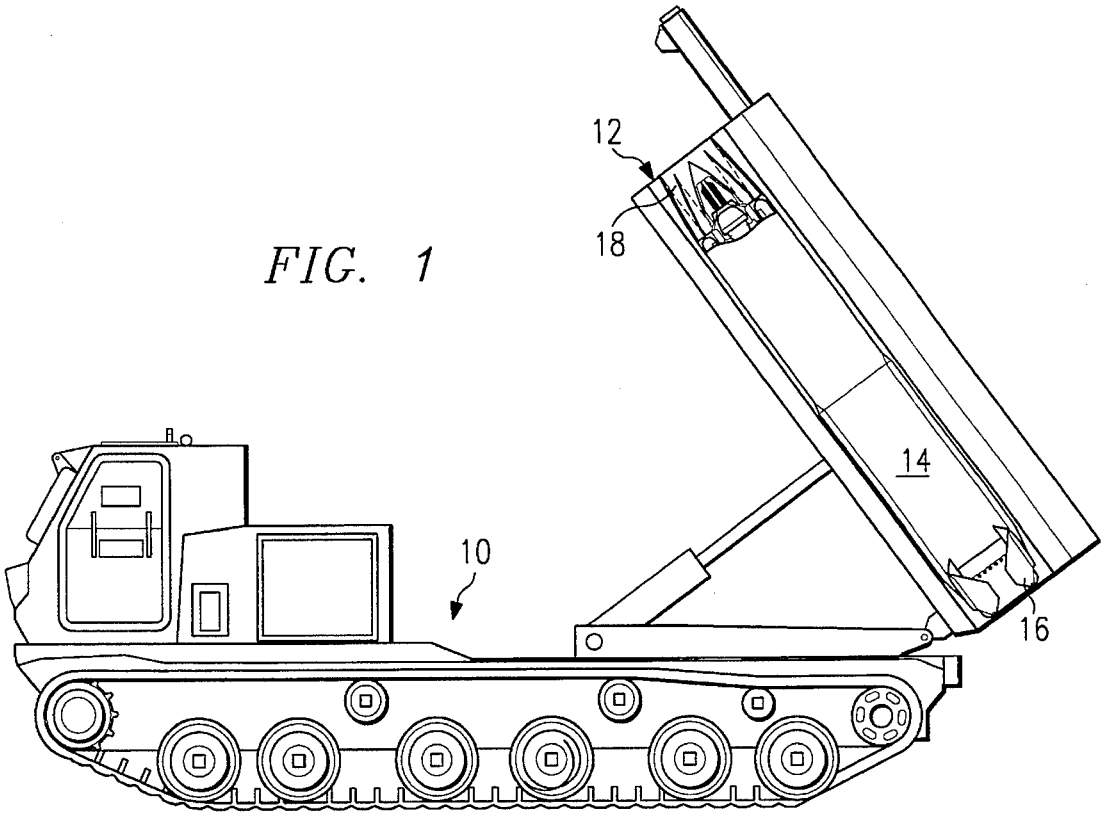
FIG. 1 is a side view of a typical launcher incorporating a modular system using an expandable ogive forming a first embodiment of the present invention.
Figure 2:
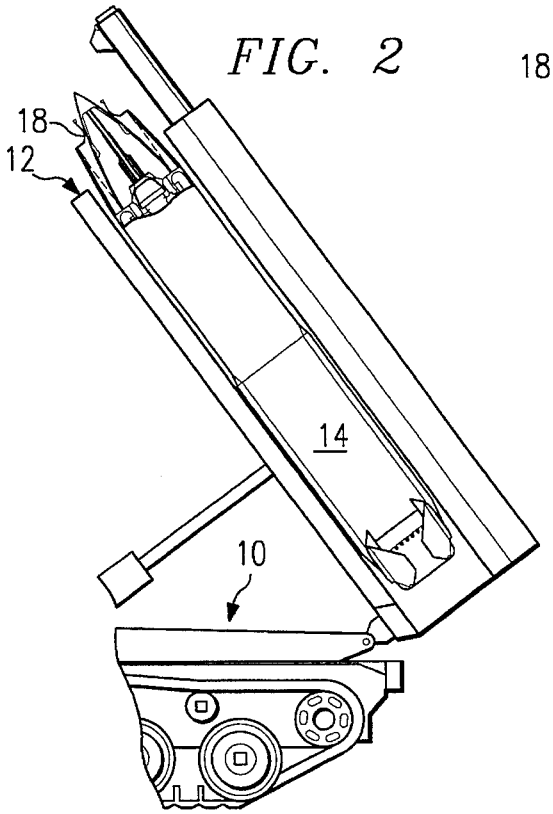
FIG. 2 is a side view of the launcher of FIG. 1 showing the expandable ogive partly activated.
Figure 3:
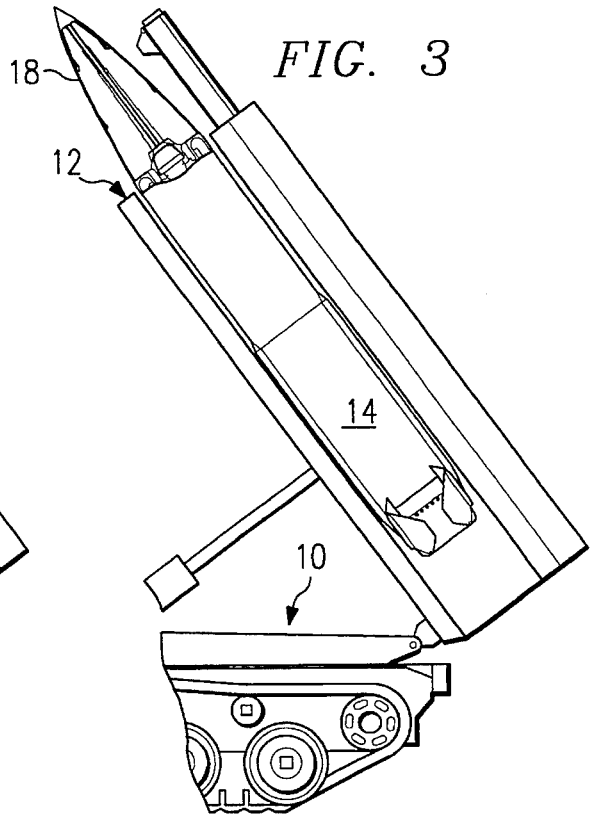
FIG. 3 is a side view of the launcher of FIG. 1 showing the ogive completely activated for launch.

With reference now to FIGS. 1–3, a mobile launcher 10 is illustrated, which can, for example, be the U.S. Army M-270 launcher. The mobile launcher mounts a MLPA 12 which can contain a variety of ordnance. In the configuration illustrated in FIGS. 1–3, the module contains a missile 14 of the type used by the US Army as a tactical missile or TACMS. The use of a standard size MLPA has significant benefits in permitting the use of a single mobile launcher 10 to launch a variety of weapons systems, such as MLRS rockets or TACMS missiles.

Figure 4:
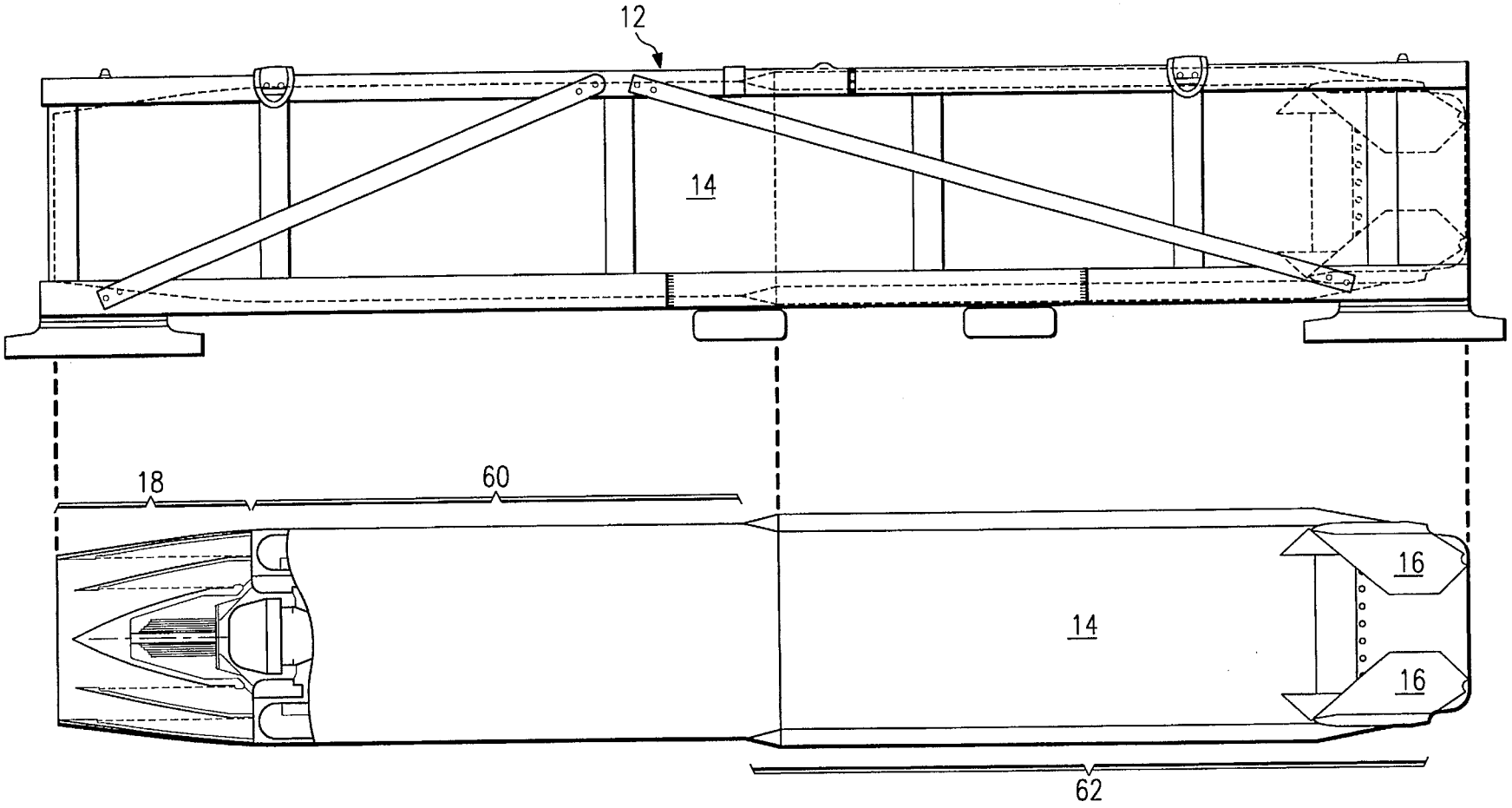
FIG. 4 is a side view of a module illustrating the missile stored therein.
Figure 5:
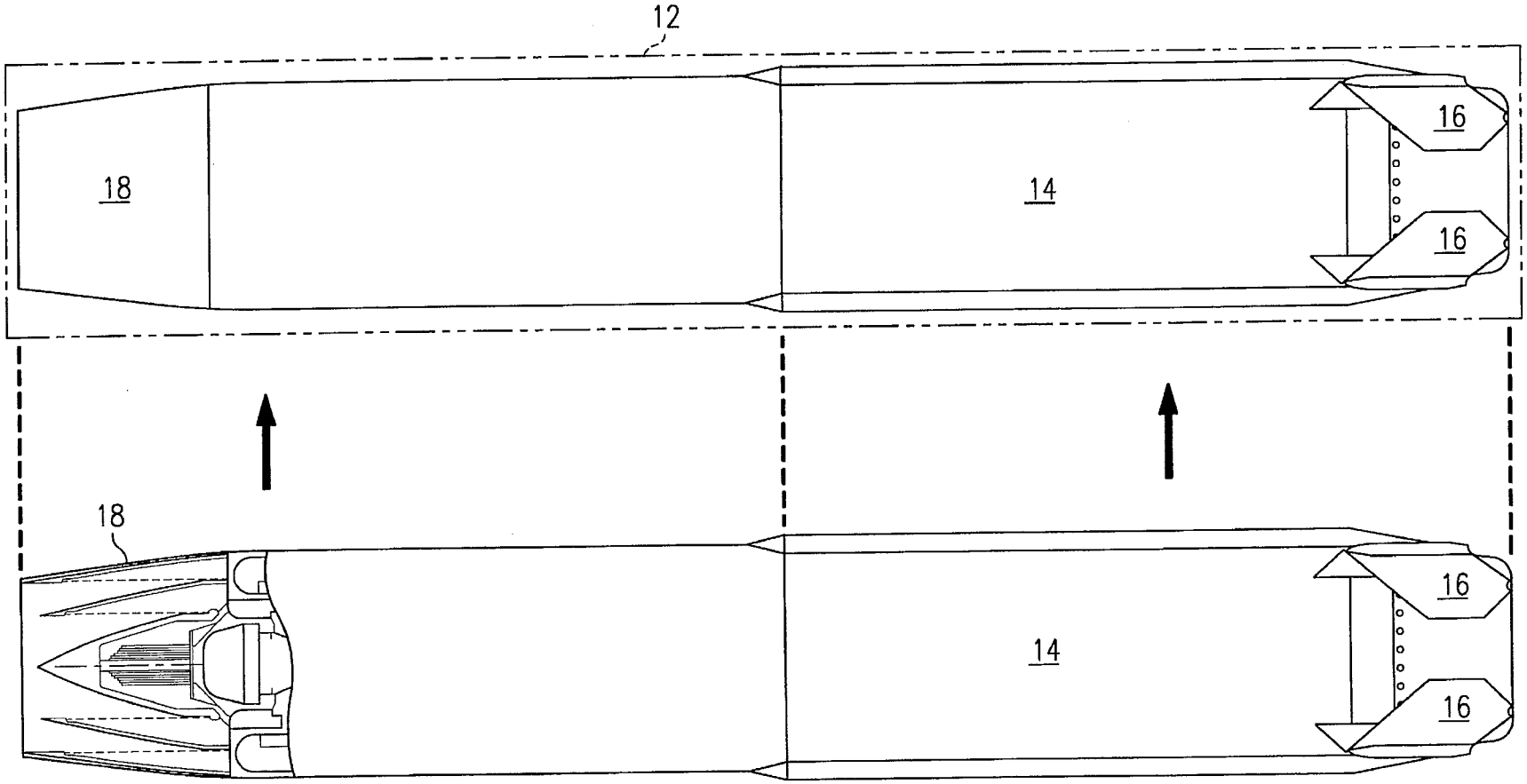
FIG. 5 is a side view of a module illustrating the missile.

As seen in FIGS. 4 and 5, the missile 14 contained within MLPA 12 has folded tail fins 16 and a contracted ogive module 18 which permit it to fit within the physical confines of the MLPA. Both fins 16 and ogive 18 are extended during flight. In addition to the ogive module, the missile also has a payload module 60 carrying the guidance and munitions, and a motor or propulsion module 62 carrying the fuel for propulsion and fin control actuators.

Figure 6A:
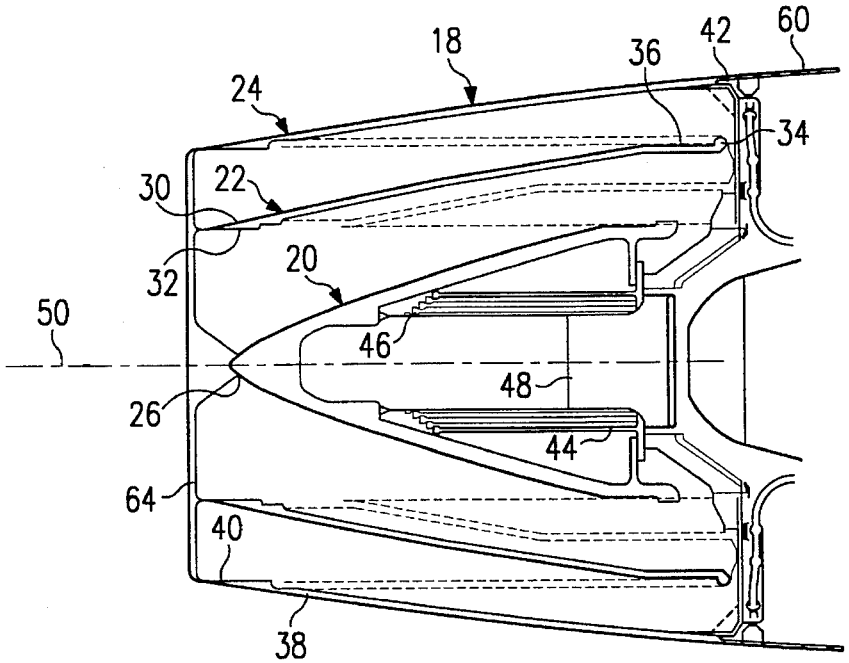
FIGS. 6A, 6B and 6C illustrate the expandable ogive moving from the compact storage position to the extended position.
Figure 6B:
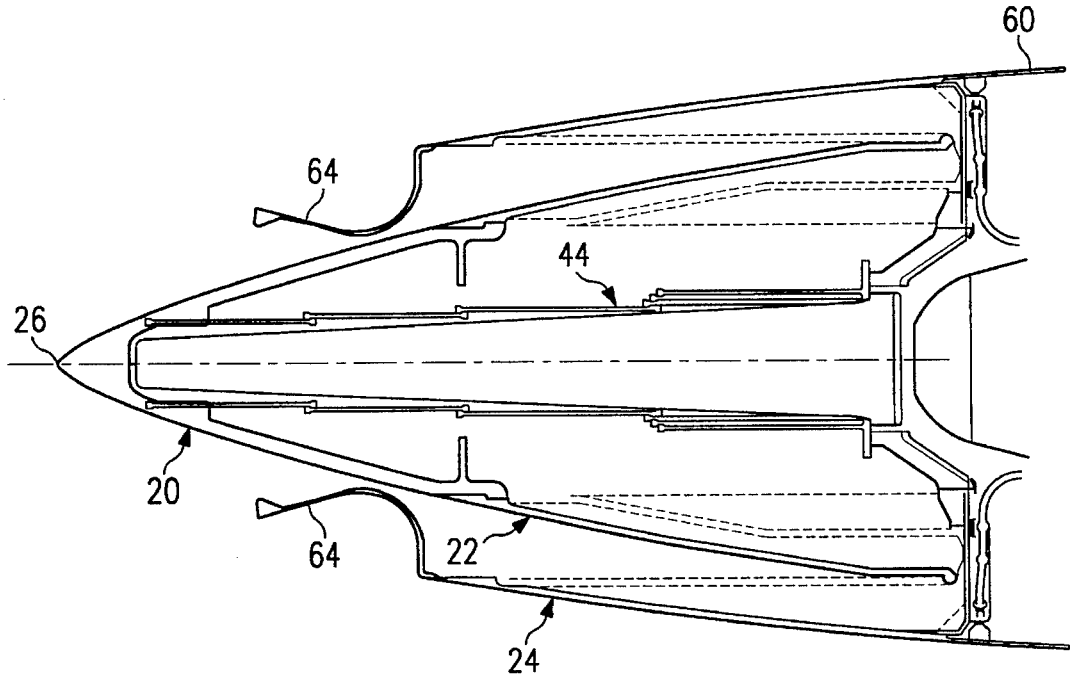
Figures 6C, 8:
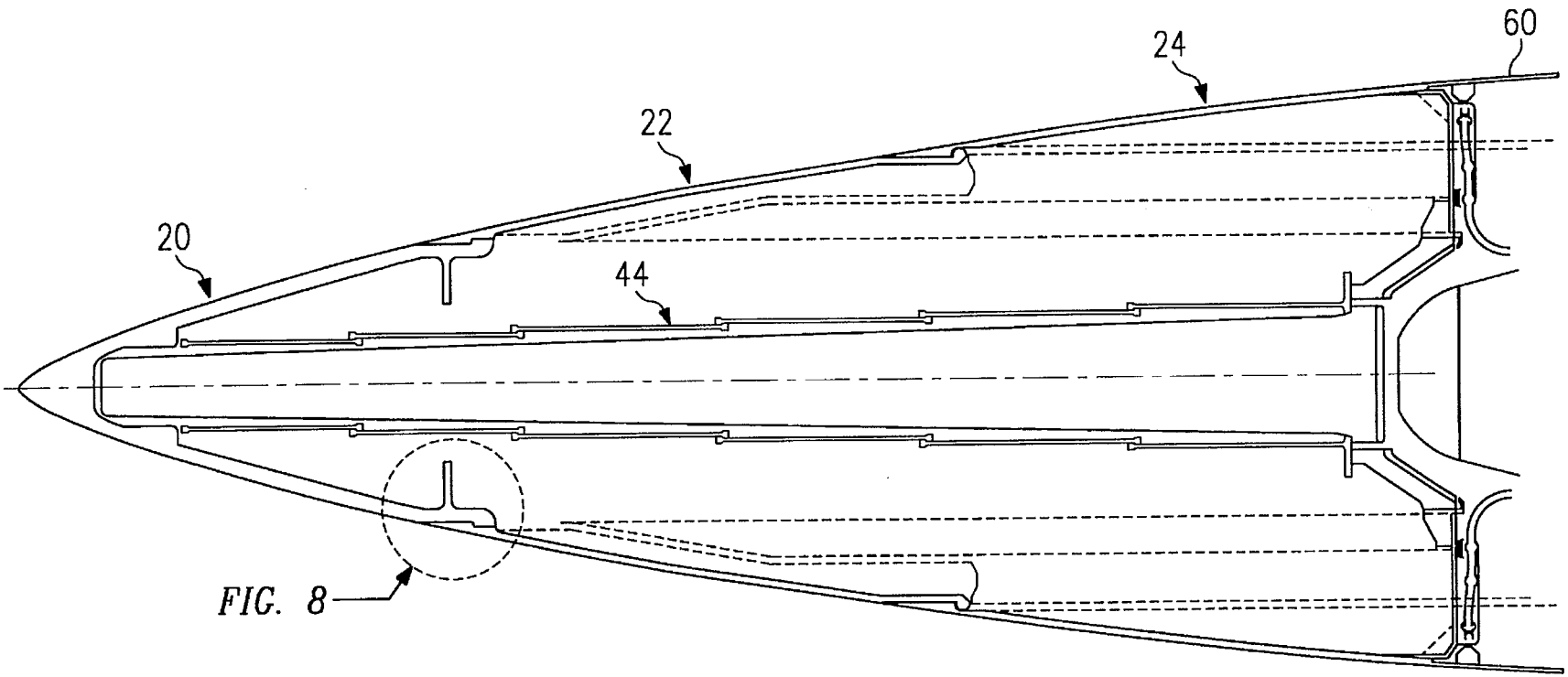
FIG. 8 is a cross-sectional view of mating sections of the ogive illustrating the fit between the sections.

The ogive 18, shown in more detail in FIGS. 6A, 6B, and 6C, forms an improvement over existing static nose shapes for certain payloads. The ogive 18 is illustrated as being formed of three sections, forward section 20, intermediate section 22 and rearward section 24. As will be apparent, other designs can use less or more sections while employing the principles of the present invention.

The forward section 20 has a generally conical configuration, having a tip 26 at the forward end, with the body of the forward section expanding rearward from the tip to an exterior tapered trailing surface 28, as best seen in FIG. 8. The intermediate section 22 has a forward end 30 with an interior tapered surface 32 and an rearward end 34 with an exterior tapered surface 36. The rearward section 24 has a forward end 38 with an interior tapered surface 40 and a rearward end 42 which is fixedly attached to the remainder of the missile 14, typically the payload module 60.

Figure 7A:
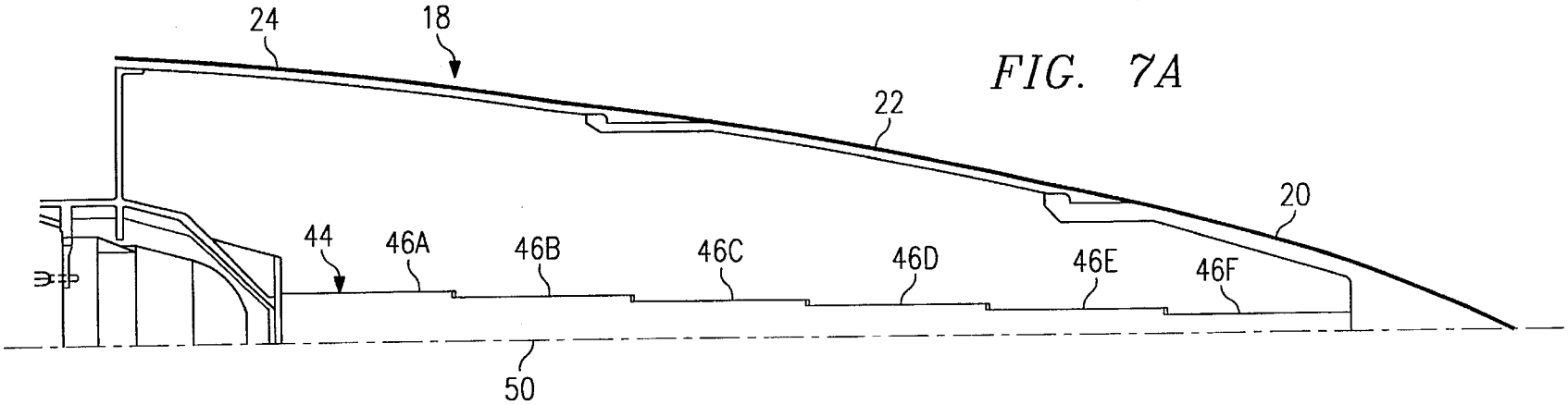
FIGS. 7A and 7B are side views in cross section of the expandable ogive illustrating the telescoping actuator in the extended position and the storage position, respectively.

A telescoping cylinder actuator 44 is mounted within the ogive and is secured at its rearward end to the payload module and at its opposite end to the forward section 20. The actuator includes a series of piston sections 46A, 46B, 46C, 46D, 46E AND 46F and a hot gas generator 48 as best seen in FIG. 7A. When the hot gas generator is ignited, hot gases build up pressure within the actuator and drive the piston sections of the actuator forward to extend the ogive, as seen in FIGS. 6B and 6C. In doing so, the sections burst through a knockout cover 64 which keep dust and contaminants out of the vehicle/MLPA until launch.

With reference to FIGS. 6A, 6B and 6C, as the sections 20 and 22 are moved forward by the actuator 44, the tapered surfaces between the various sections will move into interference contact with each other with the lip 33 on section 22 being forced radially outward as it moves into contact with the outer surface of section 20 near point 35. As the ogive sections move to the extended position, the lip 33 snaps back into a notch 37 in section 20, as shown in FIG. 8. In the extended position, a stop ring 56 on the forward section contacts an annular stop 52 on the forward end of the intermediate section 22. The rearward end 34 of intermediate section 22 and the forward end 38 of rearward section 24 have essentially the same configuration as shown in FIG. 8 as well.

Figure 7B:
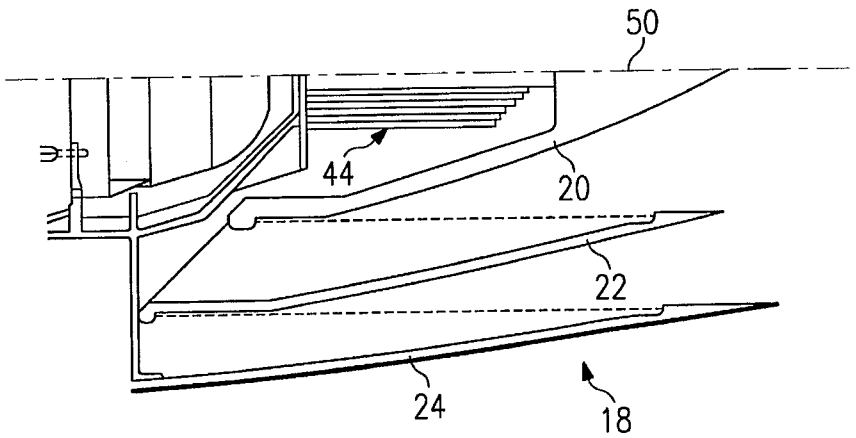
Figure 8:
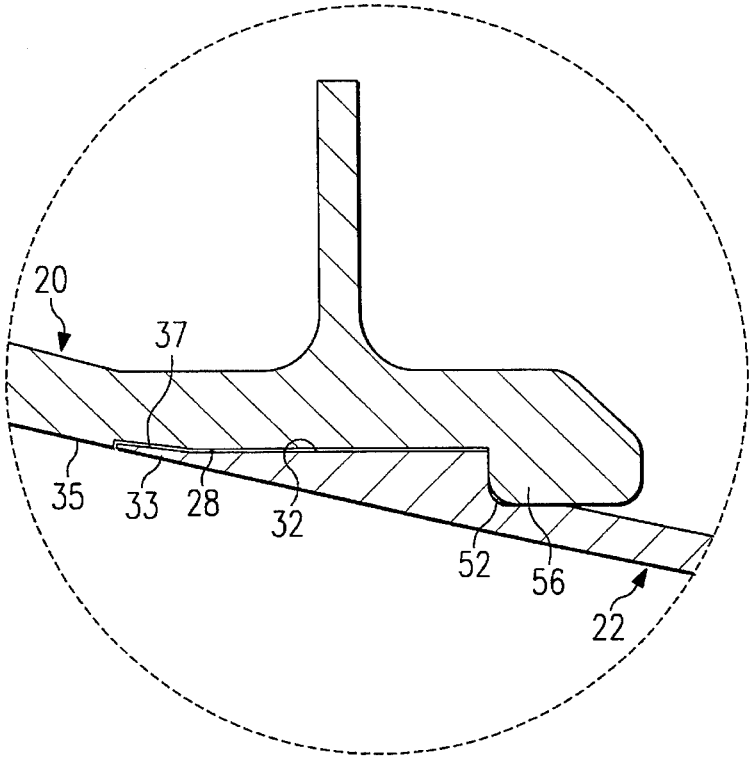

As the actuator 44 generates hot gas, the piston sections 46A–46F will begin extending relative each other, forcing the sections 20 and 22 to move forward along the center axis 50 of the missile. As seen in FIGS. 7A and 7B, the inner and outer surfaces of each piston section have a non-zero taper of less than 2° relative to the center axis 50, being tapered inwardly toward the tip 26 of the forward section 20. The mating tapered surfaces of the piston sections are dimensioned so that as the sections move to the extended position, the tapered surfaces permanently lock the sections together in the extended configuration.

The proper taper to use to achieve the desired result is less than about 2° and preferably between 1° to 1½°. This taper is similar to the Morse taper used in machine tool design. The taper will vary as a function of the type of material used in the piston sections, usually steel, the diameter and mass of the piston sections, and the velocity of the piston sections as they are moved to the extended position by the gas propellant of actuator 44.

Figure 9:
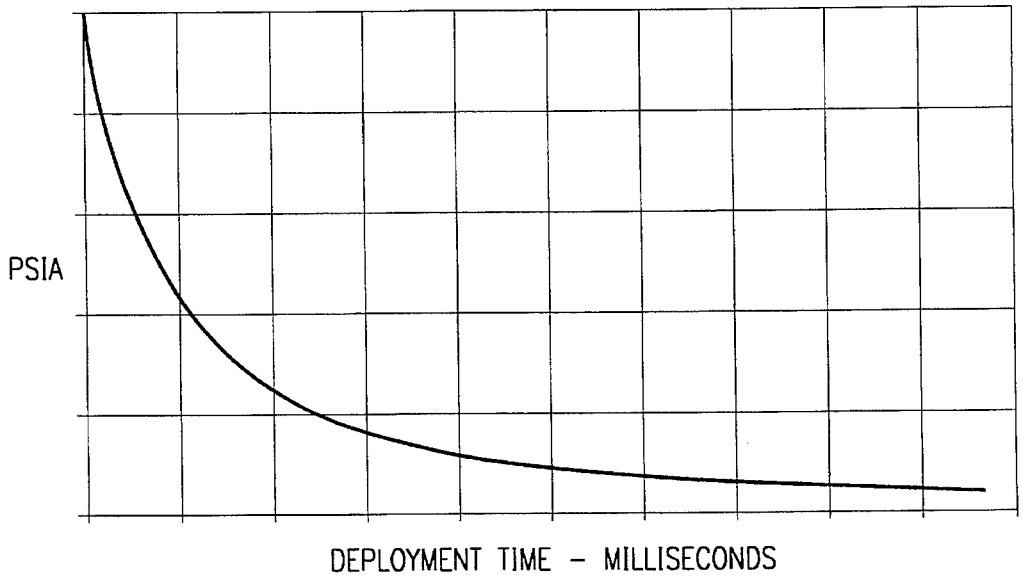
FIG. 9 is a plot of operating pressure versus deployment time for the TACMS and ogive.

FIG. 9 generally represents a graph plotting the operating pressure generated by the gas generator within the interior of the piston sections versus the deployment time necessary to extend the ogive. As would be anticipated, the higher the pressure tolerated within the piston sections, the shorter the deployment time.

Figure 10:
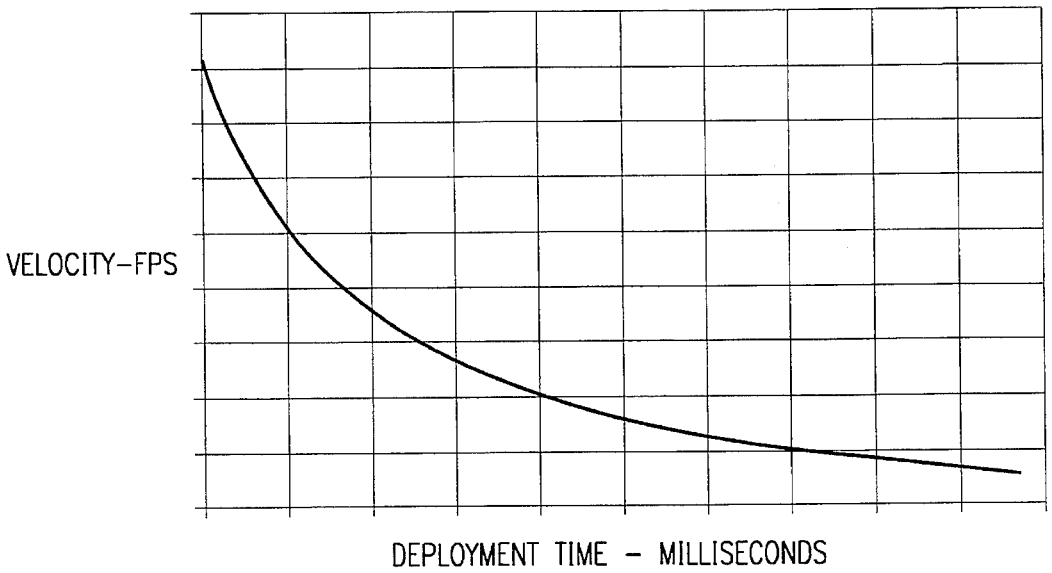
FIG. 10 is a plot of the velocity at the end of the stroke of the ogive versus deployment time.

FIG. 10 generally shows the relationship between the velocity of the piston sections and the ogive sections as they approach the extended position. Again, as would be expected, a short deployment time would require a higher end velocity at the end of the stroke. As can be understood, the outward deflection of the lips 33 on the ogive sections 22 and 24 and the tapered engagement of the piston sections will significantly slow the velocity of the ogive sections and the piston sections as they move into the final, extended position. Thus, the plot in FIG. 10 generally represents the maximum velocity the ogive sections and piston sections will achieve, which is some position prior to full extension. The energy necessary to deform the lips 33 and to engage the tapered surfaces of the piston sections will convert a significant portion of the kinetic energy of the ogive sections and piston sections, lessening the impact on the components as they move to the extended position.

Figure 11:
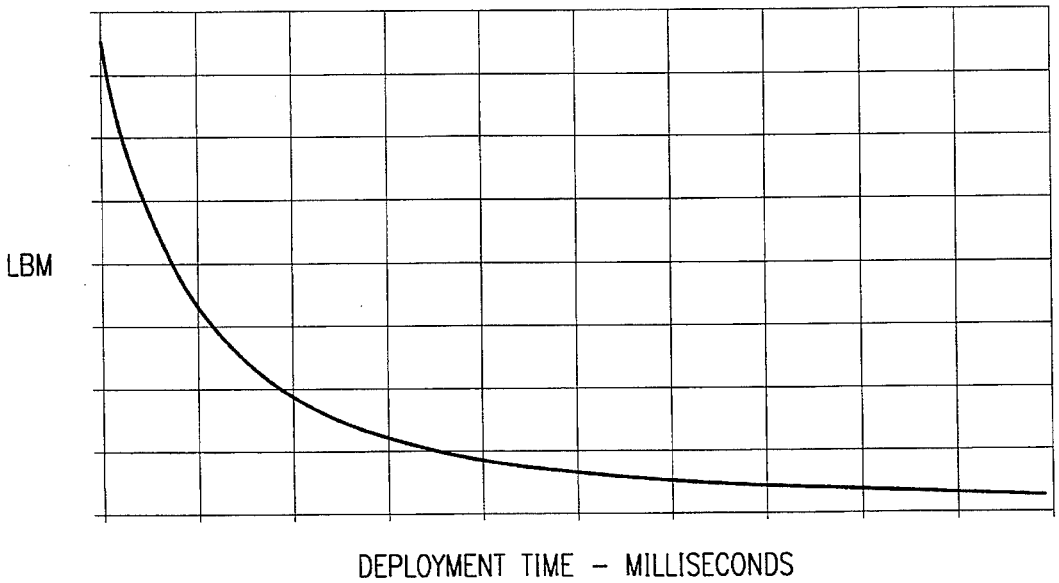
FIG. 11 is a plot of the gas generator propellant required versus deployment time.

FIG. 11 illustrates a plot of the quantity of propellant required in the gas generator versus the deployment time. As would be anticipated, the greater the quantity of the propellant, the shorter the time for deployment will be.

The present design overcomes disadvantages of existing telescoping systems. In existing systems, it is difficult to use hot gas actuators to both extend the ogive and maintain the ogive in the extended position because the gases will cool, and thereby reduce pressure significantly during flight. While cold gas generators are available which reduce this problem, the actuator must still be relatively gas-tight to maintain the ogive in the extended position during the entire flight time and this requires a precision built and expensive actuator.

The tapered design of the present invention is also an improvement over other known locking or latching technologies in the industry which lock telescoping sections together in the extended configuration. For example, the Trident D-5 program uses a telescoping cylinder which deploys an aero spike. The device uses a lock ring system and tolerance requirements that have resulted in a system which is quite expensive. Another design included a screw actuator which rotated a screw thread to extend a windscreen. This added significant weight and complexity to the design.

The material of the ogive sections and piston sections will be such as to allow for the desired function. For example, the material ductility should not be exceeded. Low elongation is permissible, but not permanent deformation or yielding. The design also offers a relatively low radar profile while optimizing structural integrity. This is particularly so in the lips 33 snapping into the recesses 37 as the ogive moves to the extended position to hide the edge of the lip from radar. The taper of shanks and sockets of standard Morse tapers is approximately ⅝ inch per foot in most cases, the present invention is modified from that taper to less than about 2°. The internal pressurization dynamics will be the determining factor on tapered length and wall thickness using standard Morse taper load requirements and known press fit calculations. These variations will need to be determined based on the application and subsequent work environments as well as survivability and length of mission requirements. The dynamic relationships of material loading under known pressure profiles are understood by those well-versed in the technology.

When the sections are made of steel, the ductility of the steel needs to be in the area of typical tool steels in which such tapers are used. The interfaces of the tapered surfaces should follow the guidelines of the Morse taper except for the 1°–2° taper angle and a ground finish across the length of engagement of a machine finish of less than 16 and preferably 8. This taper will have a predictable point of seizure and final engagement can be predicted by the stops 52 and 56 which will contact at the end of the stroke of the adjacent ogive sections and be held in that position by the locking of the piston sections. Thus, the taper of less than 2° will seize the telescoping center section while the outside skins will be held in the optimum aerodynamic and low radar cross-section configuration. Any remaining tolerances can be carried by the residual pressure of the gas actuator over the duration of the flight.

Conventional locking schemes, internal bags or ballutes in standard gas generators and pressurization schemes offer severe and expensive problems with regard to manufacturing tolerance build-ups. The present invention offers a means of supplying a rigid center structure whose propellant-actuated press fit forms a rigid center structure with strength that rivals that of a solid structure. The final position is arrested by the engagement of the stops to provide a precision controlled final ogive shape. The interaction of the invention forms a cohesive and structurally-comprehensive center structure which can extend the aero farings, handle aerodynamic loads, maintain structural integrity, transfer loads to missile mainframe and whose final arrest takes place with an aerodynamic shape critical for a maneuvering canisterized tactical missile, canisterized ballistic rocket or captive vehicle.

The initiation of the gas actuator is preferably accomplished by the sensing of motor pressure in the motor module, whose rise after motor ignition is a repeatable, reliable physical parameter unique to a launch. A pressure transducer located in the forward motor dome, for example, would close the initiator circuit of the expandable ogive to extend the nose at a point when and only when the pressure and the motor will ensure the expulsion of the missile from the launch vehicle. This is to ensure the launcher will remain unencumbered and maneuverable should a missile failure occur. A failed missile which is extended to 17 feet with an extended ogive sticking out of a 13 foot long MLPA at a 57° elevation over the cab launch would prove hazardous.

The canisterized variable geometry vehicle concept makes it impossible for opposing forces to determine nose shape, payload or motor size and therefore range, mission or capabilities of what is in the MLPA. Thus, opposing forces can only consider worst case scenarios on any mission analysis, providing a significant advantage to friendly forces.

As an example, an Army TACMS missile, in its block I configuration, would have an ogive of 3.07:1 von Karman (vK). The payload is approximately 1000 M-74 grenades. For the block II configuration, the payload would be 13–18 anti-tank submunitions with an ogive of 1.87:1 vK. The anti-tank submunitions are volumetrically inefficient for packaging in a standard missile with a more blunt ogive. The expandable ogive would give the packaging of, essentially, a right circular cylinder in the MLPA. It would offer a finer ogive of 2.4:1 vK to provide much finer aerodynamic performance in addition to an increased payload for block II or more motor and therefore range for block I.

The block I configuration using an expandable ogive and its volumetrically efficient payload of grenades would allow as much as 26 inches of additional motor with a substantial increase in range. The block II configuration as described would increase its payload from 18 to 30 submunitions. With repackaging of electronics, guidance and other boxes within the warhead, a final payload of 34 might be achieved.

The basic volume of the missile and its container is constrained. To obtain the desired ogive with a minimum number of ogive sections, it was decided to use a 2.4:1 vK and 3 ogive sections. However, clearly fewer or more sections can be used as desired.

Figure 12:
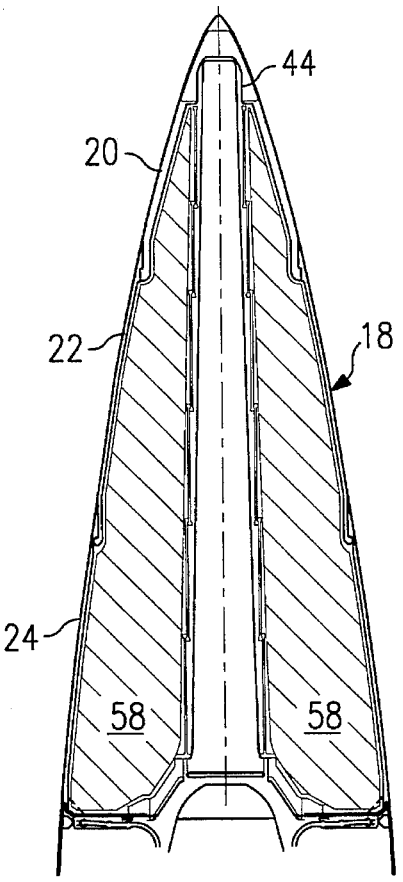
FIG. 12 is a cross-sectional view of an ogive expanded by a pressurized bag.
Figure 13:
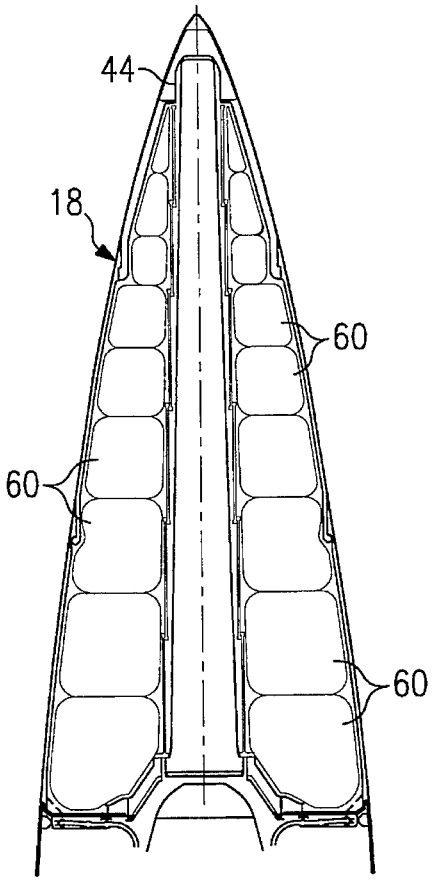
FIG. 13 is a cross sectional view of an ogive expanded by a plurality of pressurized bladders or bags.

With reference to FIG. 12, a first modification of the invention can be seen where the actuator is formed by a pressurized bag 58 which is filled by an expanding gas to fill the ogive. The piston sections are extending into locking engagement by the bag. With reference to FIG. 13, another modification of the invention can be seen to include a plurality of pressurized bladders or bags 60 which extend the ogive. The bags or bladders can be made of silicone impregnated Kevlar, glass fibers, preformed aluminum or stainless steel.

Figure 14:
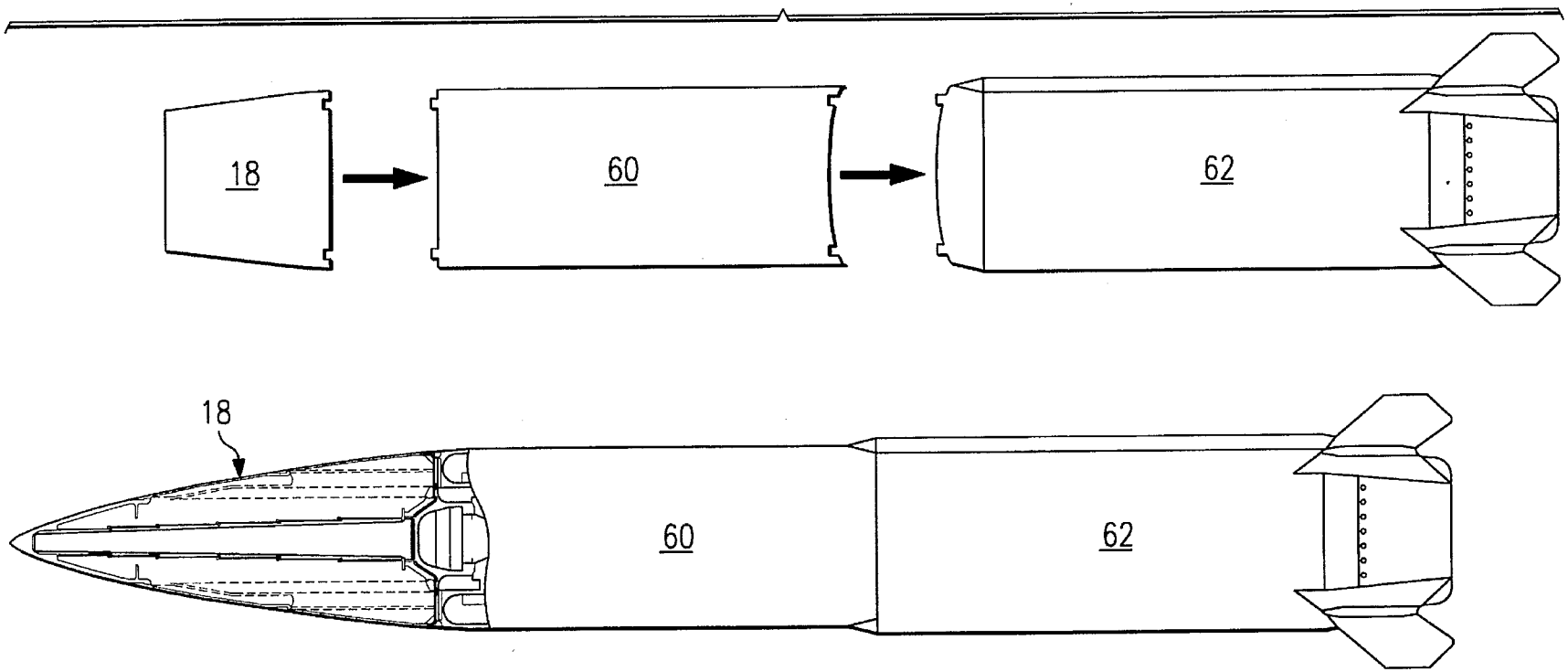
FIG. 14 is a side view of a modular concept for the TACMS.
Figure 15B:
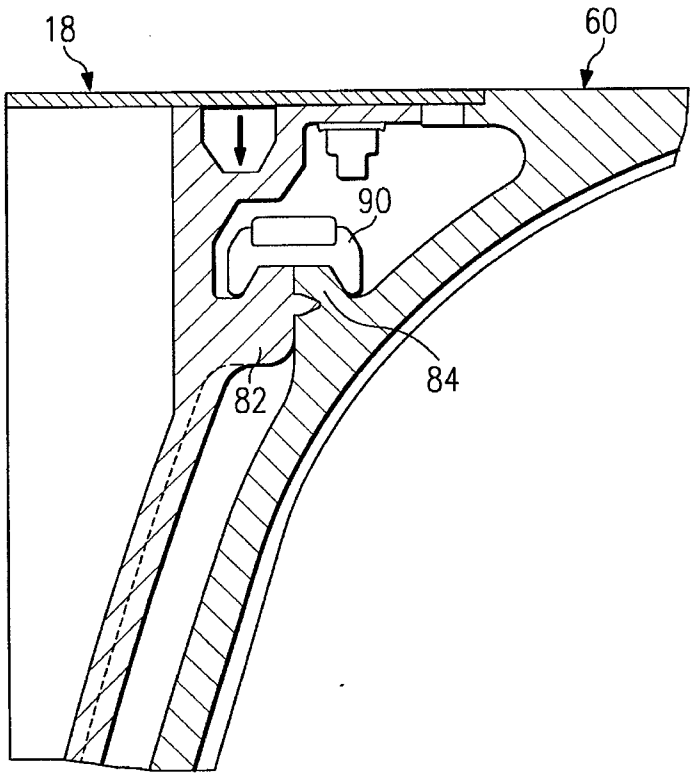
FIGS. 15A and 15B illustrate the joints in the modular concept.
Figure 15A:
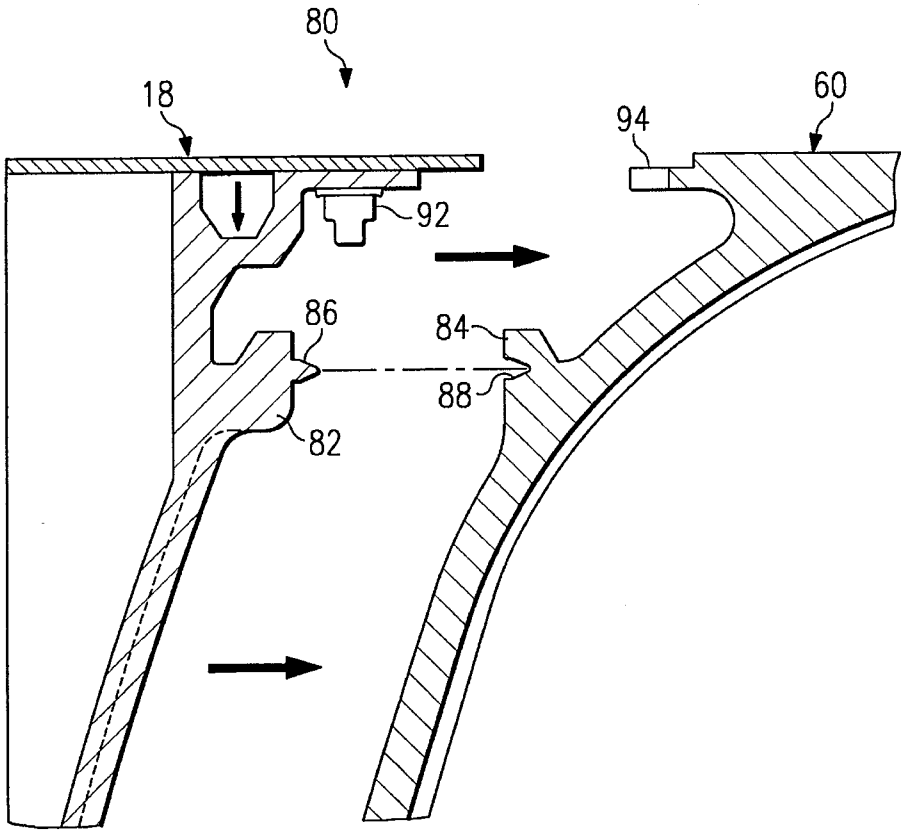

With reference to FIG. 14, another advantage of the present invention can be seen. The TACMS missile forms a modular missile system which includes the ogive module 18, a payload module 60 and a propulsion module 62. With reference to FIGS. 15A and B, the modules can be seen to be fastened together by a modular joint 80. A joint 80 is used between ogive 18 and module 60 and another joint 80 between modules 60 and 62. The modular joint includes a male positioning ring 82 on the forward module and a female position ring 84 on the rearward module. The male position ring 82 has an annular rim 86 which mates with an annular groove 88 in the female position ring 84 to position the modules in their proper relative orientation. The modules can then be secured together by use of an annular ring 90 and a series of bolts through the mating outer skirts 92 and 94 of the modules.

The use of modules provides a tremendous advantage to flexible use of the TACMS system. For example, a longer, and therefore larger propulsion module can be used with a shorter, and therefore smaller payload module and/or ogive to lengthen the flight capability of the missile. Alternatively, a shorter propulsion module can be used, which allows an increase in the size of the payload module to provide additional ordnance capabilities in the missile. As noted previously, the ogive can also be modified to change flight characteristics. In fact, the ogive can be maintained in the storage position during flight to radically shorten the range of the missile for purposes of practice on a smaller range or attacking enemy forces which have penetrated close to the launcher.

Figure 16:
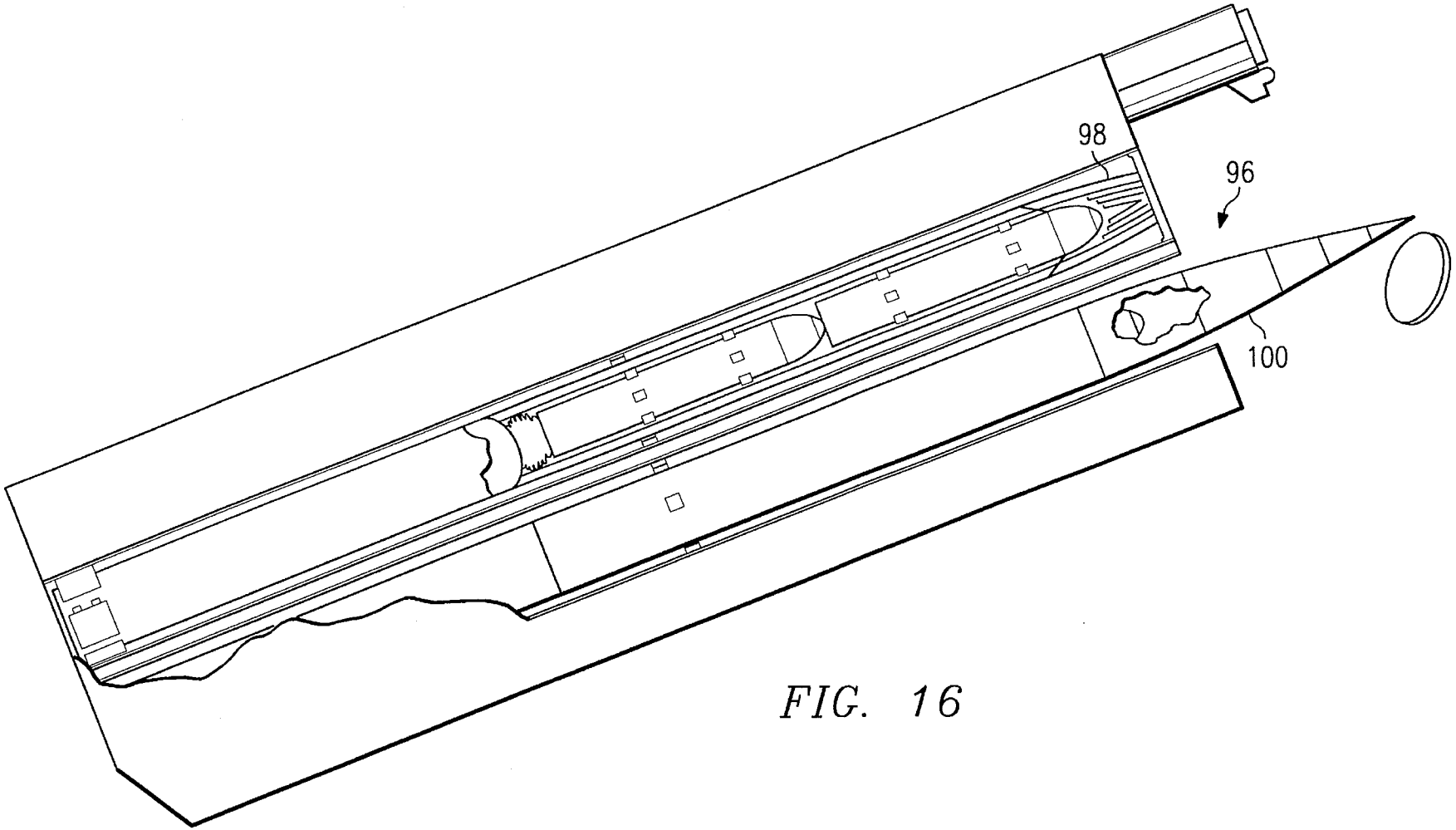
FIG. 16 is a side view of an MLRS/BAT delivery system.

The modularization system provides great flexibility to the user to select a particular range, payload and flight characteristic suitable in a given situation. Since the TACMS is contained within a container of set shape and size, the opposing forces cannot visually detect the configuration of the missile system, providing a strategic advantage to the system. For example, FIG. 16 illustrates an MLRS/BAT delivery system 96 which has a missile 98 capable of launching individual BAT munitions from a single missile. The missile 98 illustrated in FIG. 16 has not yet had the ogive extended. The missile 100 has extended the ogive and is in the process of launching.

Although a single embodiment of the invention has been described in the foregoing description and illustrated in the accompanying drawings, it will be understood that the invention is not limited to the embodiment disclosed, but is capable of numerous rearrangements, modifications and substitutions of parts and elements without departing from the spirit and scope of the invention.

I claim:

1. An expandable ogive for a missile or rocket, comprising:

a plurality of concentric sections, at least a first of the concentric sections, having a trailing surface and at least a second of the concentric sections having a leading surface;

the plurality of concentric sections moveable between a compact configuration with the concentric sections nested to an expanded configuration with the concentric sections forming an ogive;

the trailing surface or the first concentric section engaging the leading surface of the second concentric section in the expanded configuration;

the trailing surface of the first of the concentric sections having an expanding portion and a groove and the leading surface of the second of the concentric sections having a lip, the lip being expanded over the expanding portion as the first of the concentric sections moves to the expanded configuration, the lip entering the groove with the concentric sections in the expanded configuration.

2. The expandable ogive of claim 1 further comprising an actuator to move the concentric sections from the compact configuration to the expanded configuration.

3. The expandable ogive of claim 2 wherein the actuator includes a plurality of piston sections, the piston sections tapering at an angle of less than two degrees, the piston sections being locked together when the expandable ogive is in the expanded configuration.

4. The expandable ogive of claim 1 having three concentric sections including a forward section, an intermediate section and a rearward section.

5. The expandable ogive of claim 3, having six piston sections.

6. The expandable ogive of claim 1 wherein the trailing surface of the first of the concentric sections has a stop portion thereon, the leading surface of the second of the concentric sections having a stop surface thereon, the stop surfaces engaging when the ogive is in the expanded configuration.

7. The expandable ogive of claim 2 wherein the actuator includes a gas propellant.

8. A method for expanding an ogive for a missile or rocket having a centerline axis, comprising the steps of:

nesting at least a first ogive section within a second ogive section in a compact configuration;

actuating an actuator including a plurality of piston sections, to move the first ogive section along the centerline axis relative to the second ogive section to an extended configuration, at least a portion of each of the piston sections having a taper to lock the piston sections in the extended configuration to form the ogive.

9. The method of claim 8 wherein the step of actuating the actuator includes the step of actuating a hot gas generator.

10. The method of claim 8 wherein the second ogive section has a forward end and the first ogive section has a trailing end, the method further comprising the step of expanding the forward end of the second ogive section with the trailing end of the first ogive section as the first section moves to the extended configuration, a lip at the forward end of the second ogive section moving into a groove at the trailing end of the first ogive section when the first ogive section is in the extended configuration.

11. The method of claim 8 wherein the second ogive section has a leading end and the first ogive section has a trailing end, the method further comprising the step of stopping the motion of the first ogive section along the centerline axis by engaging a stop surface on the trailing end of the first ogive section with a stop surface on the leading end of the second ogive section.

12. A method for expanding an ogive for a missile or rocket having a centerline axis, comprising the steps of:

nesting at least a first ogive section within a second ogive section in a compact configuration;

actuating an actuator to move the first ogive section along the centerline axis relative to the second ogive section to an extended configuration to form the ogive:

the step of actuating the actuator including the step of moving piston sections relative each other along the centerline axis, at least a portion of the piston sections having a taper of less than about two degrees to lock the piston sections in the extended configuration.

13. A method for expanding an ogive for a missile or rocket having a centerline axis, comprising the steps of:

nesting at least a first ogive section within a second ogive section in a compact configuration;

actuating an actuator including a plurality of piston sections, to move the first ogive section along the centerline axis relative to the second ogive section to an extended configuration to form the ogive; and slowing the movement of the first ogive section along the centerline axis by the locking of a taper in the piston sections as the first ogive section moves into the extended configuration.

* * * * *

UNITED STATES PATENT AND TRADEMARK OFFICE

CERTIFICATE OF CORRECTION

PATENT NO. : 5,494,239

DATED : February 27, 1996

INVENTOR(S) : Jeffrey A. Giacomel

It is certified that error appears in the above-indentified patent and that said Letters Patent is hereby corrected as shown below:

Col. 6, line 65, delete the word "or" and insert the word --of--.

Signed and Sealed this

Twenty-second Day of October, 1996

*Attest:*

Bruce Lehman

BRUCE LEHMAN

*Attesting Officer*

*Commissioner of Patents and Trademarks*